US006758147B2

(12) United States Patent
Howard et al.

(10) Patent No.: US 6,758,147 B2
(45) Date of Patent: Jul. 6, 2004

(54) BALLAST DISCHARGE SYSTEM

(75) Inventors: Joel S. Howard, Bedford, TX (US); William McCarthy, Keller, TX (US)

(73) Assignee: The Burlington Northern and Santa Fe Railway Co., Fort Worth, TX (US)

( * ) Notice: Subject to any disclaimer, the term of this patent is extended or adjusted under 35 U.S.C. 154(b) by 0 days.

(21) Appl. No.: 09/912,831

(22) Filed: Jul. 25, 2001

(65) Prior Publication Data

US 2002/0073882 A1 Jun. 20, 2002

Related U.S. Application Data

(60) Provisional application No. 60/221,068, filed on Jul. 27, 2000.

(51) Int. Cl.[7] ..... B61D 3/00

(52) U.S. Cl. ..... 105/247; 246/122 R

(58) Field of Search ..... 105/247, 239, 105/248, 249; 246/122 R, 123, 125, 126, 127; 701/19, 20

(56) References Cited

U.S. PATENT DOCUMENTS 5,809,448 A * 9/1998 Gimenez et al. ..... 246/1 R
5,867,404 A * 2/1999 Bryan ..... 342/457
5,890,682 A * 4/1999 Welk ..... 246/122 R
5,902,341 A * 5/1999 Wilson ..... 246/122 R
5,950,967 A * 9/1999 Montgomery ..... 246/122 R
5,969,643 A * 10/1999 Curtis ..... 340/933
6,044,698 A * 4/2000 Bryan ..... 73/146
6,059,372 A * 5/2000 McDonald et al. ..... 298/27
6,073,562 A * 6/2000 Cozine et al. ..... 105/247
6,142,372 A * 11/2000 Wright ..... 235/375
6,227,124 B1 * 5/2001 Gaydos et al. ..... 105/286
6,249,215 B1 * 6/2001 Dilz et al. ..... 180/287

* cited by examiner

*Primary Examiner*—Frantz F. Jules
(74) *Attorney, Agent, or Firm*—Melvin A. Hunn

(57) ABSTRACT

A cargo discharge railcar for comprising a generally rectangular base structure, a plurality of walls coupled to the base structure defining an enclosure for carrying cargo, a hopper portion coupled to the base structure, a discharge gate coupled to the hopper portion, a control system coupled to the discharge gate for opening and closing the discharge gate, a central processing unit for controlling the control system, and a global positioning system receiver electrically coupled to the central processing unit for receiving longitude and latitude data from a global positioning system transmitter orbiting the Earth. The discharge gate is adapted to be selectively opened and closed based in part upon the longitude and latitude of the cargo discharge railcar.

6 Claims, 4 Drawing Sheets

FIG. 1B
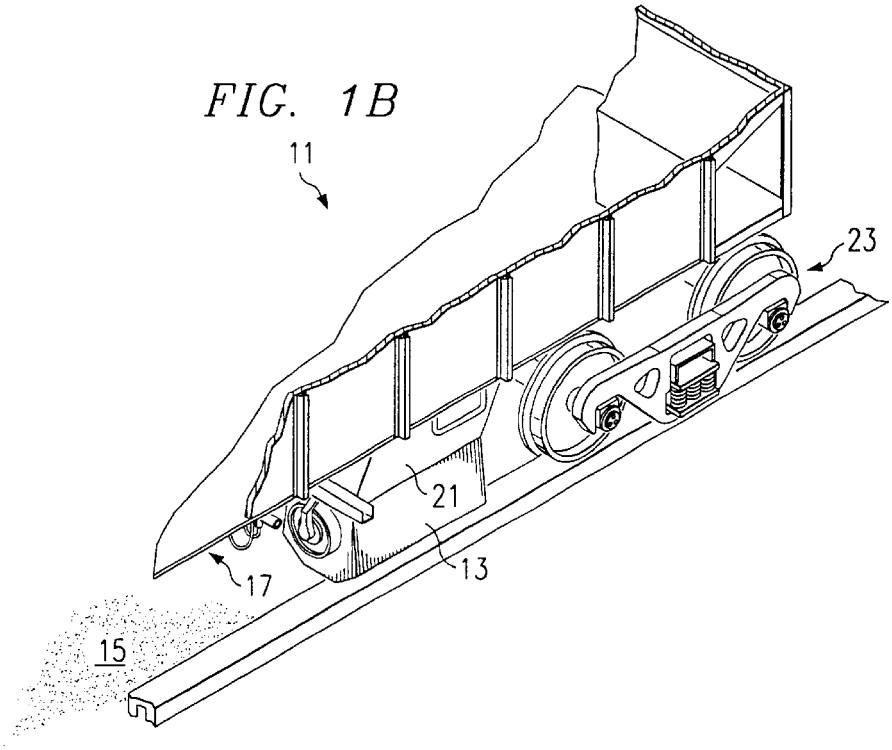
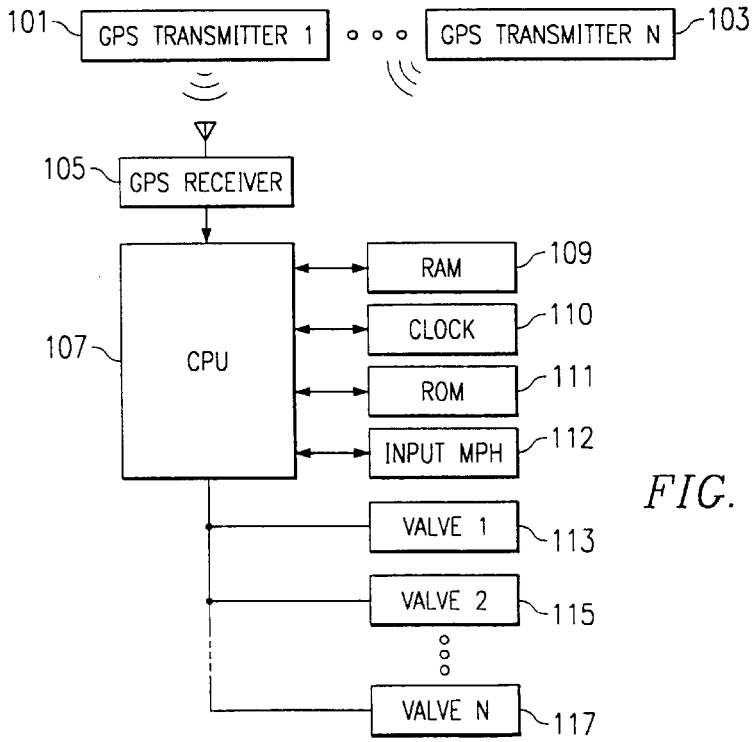
FIG. 2

FIG. 5
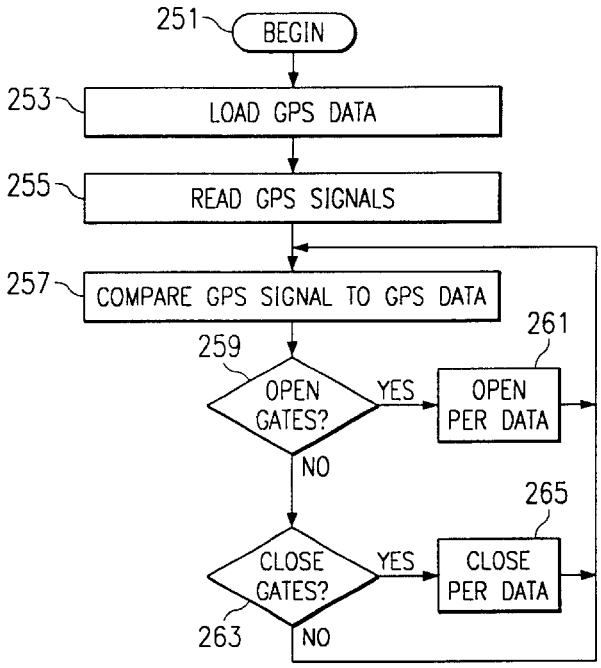
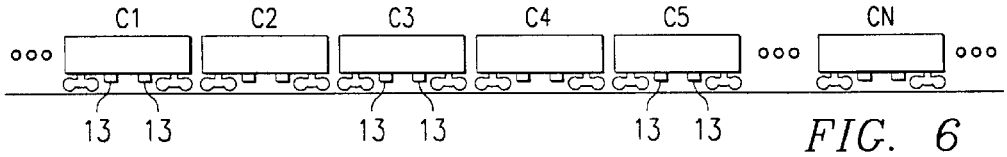
FIG. 6
FIG. 7
| POSITION | AMOUNT DISCHARGED | DISCHARGE GATE CONDITION |
|---|---|---|
| L1-L2 | X | OPEN |
| L2-L3 | 0 | CLOSED |
| L3-L4 | Y | OPEN |
| L4-L5 | 0 | CLOSED |
| L5-L6 | Z | OPEN |
| L6-L7 | 0 | CLOSED |
| L7-LN | A | OPEN |
100

BALLAST DISCHARGE SYSTEM

This application claims the benefit of U.S. Provisional Application No. 60/221,068 filed Jul. 27, 2000, titled "Ballast Discharge System."

BACKGROUND OF THE INVENTION

1. Field of the Invention

The present invention relates in general to ballast discharge equipment for use in depositing ballast material on a rail bed. In particular, the present invention relates to a computer controlled ballast discharge system.

2. Description of the Prior Art

In the late 1980's, the Burlington Northern Railroad Company initiated the development of a new type of automated ballast railcar. These railcars are operated in unit train groups and have improved the efficiency of ballast unloading by allowing workers to unload a 54-car train with only two employees, and which allowed the ballast discharge operation to be conducted at generally walking speed. The trains could unload in approximately 6 to 9 hours of track time over a period of two days. The automated unit train concept improved the cycle time on the cars (which is the time period from load to reload) dramatically from about 20 days to less than 5 days. Furthermore, it allowed operations to be conducted with fewer employees, which is beneficial from a cost and safety standpoint. By 1997, the successor to the Burlington Northern Railroad Company, the Burlington Northern and Santa Fe Railway Company ("BNSF") was using automated ballast trains to improve efficiency. This allowed the retiring of old ballast cars from the fleet. There are two types of cars generally used by BNSF. One utilizes an electrical system in which the discharge gates are radio controlled, and the other utilizes a hydraulic system in which the discharge gates are hydraulically controlled. On cars with hydraulic gates, some of the gates may be radio controlled and some may be manually controlled with actuating handles on the side of the car.

Of course, it is always desirable to operate at higher rates and with fewer personnel. The present invention is directed to an improvement to the prior art automated ballast discharge railcars.

SUMMARY OF THE INVENTION

There is a need for an improved railroad ballast discharge system that utilizes global position systems ("GPS").

It is one objective of the present invention to utilize GPS in combination with an automatic ballast discharge railcar in order to further improve ballast discharge operations by increasing the speed of operations, by reducing the number of personnel required, and by providing for relatively well controlled predictable depositions of ballast.

It is another objective of the present invention to provide an improved ballast discharge system which allows at least one controller and at least one GPS receiver to receive global position data from global position satellites, to read the global position data, to compare the global position data to global position information recorded in program memory, and to open and close discharge gates of a plurality of ballast railcars in a pre-programmed and pre-determined manner in order to deposit ballasts at pre-selected portions of the rail line and to not deposit ballast in other pre-selected portions of the rail line.

BRIEF DESCRIPTION OF THE DRAWINGS

The novel features believed characteristic of the invention are set forth in the appended claims. The invention itself however, as well as a preferred mode of use and further objectives and advantages thereof, will best be understood by reference to the following detailed description of the preferred embodiment when read in conjunction with the accompanying drawings, wherein:

FIG. 1B is an enlarged pictorial representation of one of the ballast discharge gates of the automated ballast railcar of FIG. 1A;

FIG. 2 is a block diagram representation of the present invention which utilizes a GPS receiver to provide GPS derived location data to a central processing unit;

FIG. 5 is a flow-chart representation of the operation of the computer program to selectively discharge ballast in accordance with pre-selected and pre-programmed location and discharge data;

FIG. 6 is a pictorial representation of a portion of a ballast train according to the present invention; and FIG. 7 is a tabular representation of operation depicted in FIG. 3B.

DETAILED DESCRIPTION OF THE INVENTION

Figure 1A:
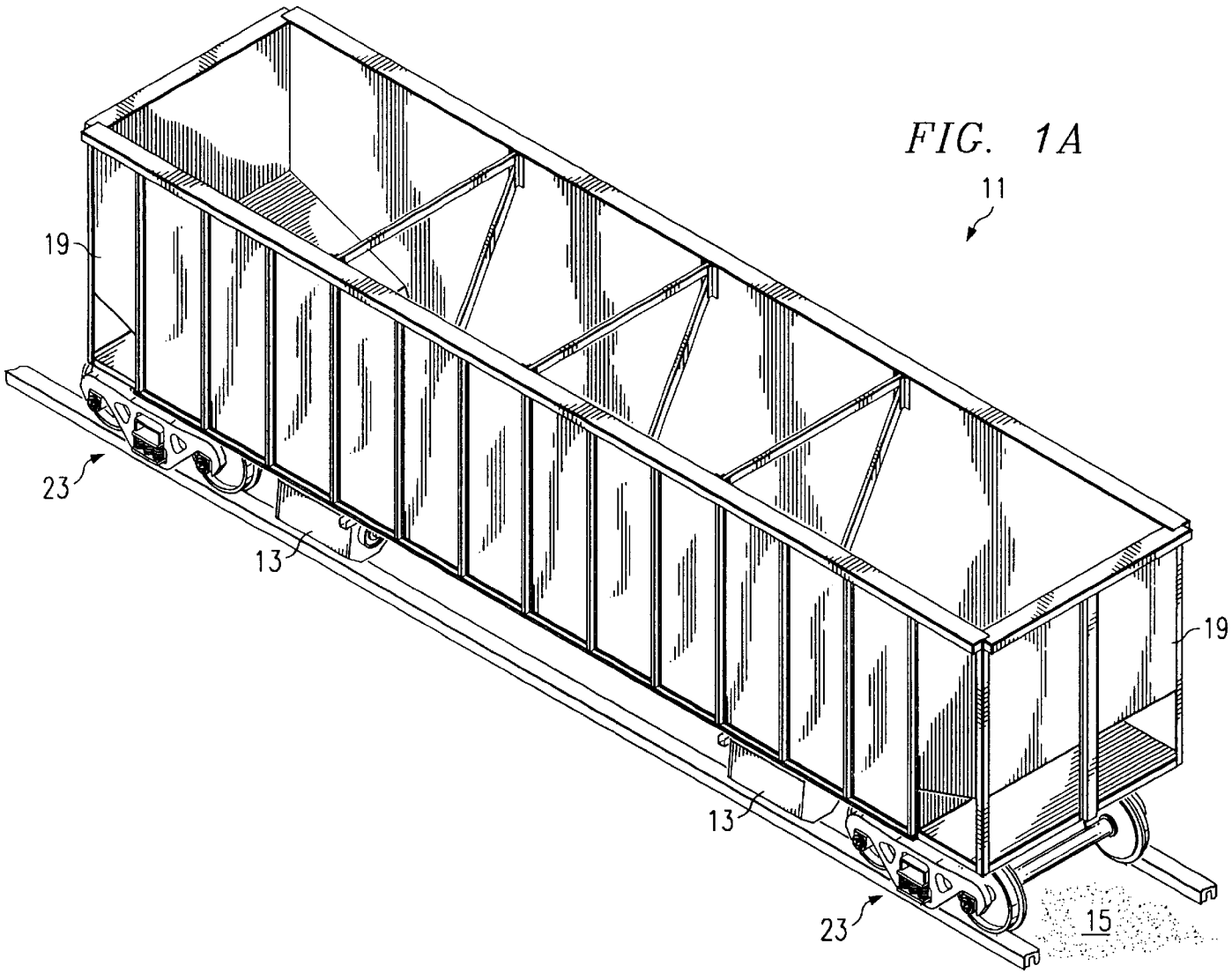
FIG. 1A is a pictorial representation of an automated ballast rail car according to the present invention.

Referring to FIGS. 1A and 1B in the drawings, pictorial representations of a cargo discharge railcar 11 according to the present invention are illustrated. Railcar 11 includes a generally rectangular base structure 17, walls 19 coupled to base structure 17, and hoppers 21 coupled to base structure 17. A plurality of rail wheel assemblies 23 are coupled to the underneath side of base structure 17. In the preferred embodiment, the cargo is railroad ballast. Discharge gates 13 may be selectively actuated and moved between an open condition and a closed condition. When in the closed condition, discharge gates 13 prevent the discharge of ballast (not shown) carried within railcar 11. When in the open condition, discharge gates 13 allow the ballast to be discharged at a pre-selected flow rate through discharge gates 13 and onto a road bed 15. Discharge gates 13 may actuated by electrical means, hydraulic means, a combination of electrical and hydraulic means, or other means for actuating similar discharge gates.

Referring now to FIG. 2 in the drawings, a block diagram representation of the present invention is illustrated. As is shown, a plurality of GPS transmitters, including GPS transmitters 101 and 103 are provided in orbit above the Earth and may be utilized in a conventional manner to determine a location in terms of latitude and longitude by the interaction between at least one GPS receiver and the one or more GPS transmitters 101 and 103. As is shown, at least one GPS receiver 105 is carried by railcar 11. GPS receiver 105 may be located in one of the ballast railcars or it may be located in some other location, such as the locomotive. GPS receiver 105 communicates GPS data to a central processing unit (CPU) 107 with which is associated conventional supporting electronics, such as RAM memory 109 and ROM memory 111. RAM memory 109 and ROM memory 111 may be utilized to record program instructions which may be executed by central processing unit 107 in order to generate signals for controlling the discharge of ballast from a series or train of cargo discharge railcars 11. Typically, a relatively large number of ballast railcars, such as fifty railcars, are utilized to deposit ballast where needed to build up road bed 15. The requirements of a particular portion of a rail line may vary. A typical ballast discharge operation will require the discharge of from one hundred to six hundred tons of ballast per mile with railcars generally containing one hundred tons of ballast per car. The tonnage that is deposited will depend upon the speed of railcars 11, the number of railcars 11 used, the number of discharge gates 13 in the open condition, and the size of discharge gates 13, which determines the flow rate of the ballast through discharge gate 13. Typically, a ballast railcar 11 carries four discharge gates on the undercarriage. Relatively simple mathematical calculations can be done to determine the number of gates which are required to be in the open condition to discharge a predetermined amount of ballast over a predetermined portion of a rail line at a given velocity. Typically, once the discharge operations begin, a number of cars are unloaded continuously through the discharge gates. For example, it is not uncommon for five cars worth of ballast to be emptied out over one mile of a rail line.

It is important to note that there may be sections of railroad in which little or no discharge is required. For example, there may be sections with turnouts or switches, road crossings, bridges, and/or tunnels which may not require any additional ballast. Accordingly, it is one objective of the present invention to allow for the selective opening and closing of gates in accordance with preprogrammed GPS location data and preprogrammed discharge data in order to deposit the appropriate amount of ballast in only the appropriate locations, and to prevent the discharge of ballast in predetermined locations which do not require additional ballast.

At present it is conventional to merely open or close discharge gates 13. However, it is possible to utilize the present invention to open and close discharge gates 13 in pre-selected amounts in order to better control or "throttle" the rate of discharge of ballast at particular portions of a rail line. At present, the ballast material is relatively uniform in both size and weight so it is practical to assume that each gate will discharge a comparable amount of ballast. It is typical to have each ballast railcar 11 carry as much as 100 tons of ballast rock.

Returning now to FIG. 2 in the drawings, as is shown, CPU 107 controls and maintains control valves 113, 115, and 117. Control valves 113, 115, and 117 operate to switch discharge gates 13 from the open condition to the closed condition, and vice versa. It should be understood that control valves 113, 115, and 117 may be either electrical or hydraulic control valves, or any other suitable control valve. Additionally, the duration of the open and/or closed condition of each gate may be determined by a clock 110 for the speed data received at input 112, which represents the current speed of the train in units of miles per hour, or any other appropriate measure of velocity. Accordingly, control valves 113, 115, and 117 may be opened and closed in accordance with preprogrammed instructions. In other words, the GPS locations at which each discharge gate 13 is opened and closed may be preprogrammed. In this manner, both location and amount of the discharge may be controlled by CPU 107.

Figure 3A:
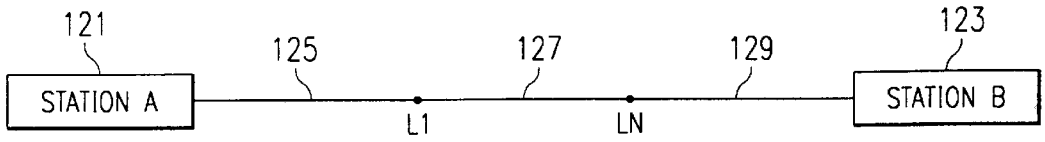
FIG. 3A is a schematic representation of a section of rail line.
Figure 3B:
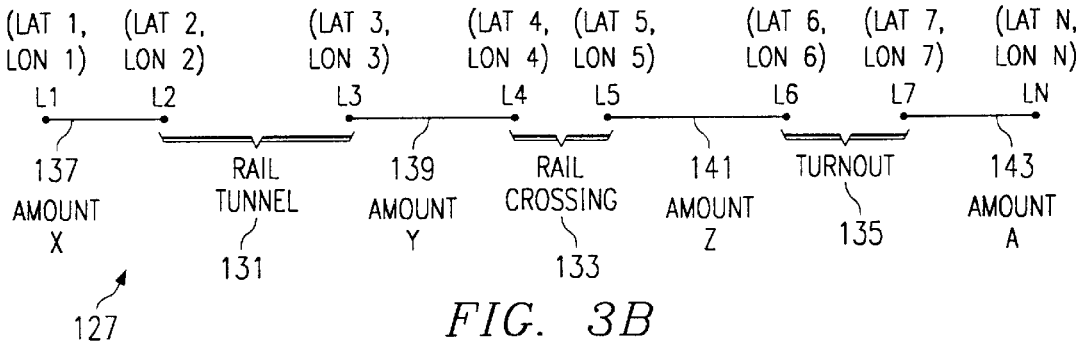
FIG. 3B is a detailed view of the section of rail line of FIG. 3A, showing pre-selected portions of the rail line in which the ballast is to be deposited or not deposited.

Referring now to FIGS. 3A and 3B in the drawings, the operation of discharging the ballast on a particular rail line is depicted schematically. As is shown, a rail line comprising sections 125, 127, and 129 extends between Station A represented by reference numeral 121, and Station B represented by reference numeral 123. In the operation depicted in FIG. 3A, section 125 of the rail line does not require any additional ballast, nor does section 129. However, section 127 of rail between location L1 and location LN does require the discharge of a particular amount of ballast. FIG. 3B is a detailed schematic depiction of the Section 127. As is shown, Section 127 begins at location L1 and ends at location LN. Location L1 is determined by GPS data in terms of latitude and longitude. Likewise, location LN is determined by a particular latitude and a longitude. As is shown, there are several rail segments, 137, 139, 141, 143 which require additional ballasts in predetermined amounts. For example, segment 137 requires an amount "X" of ballast; segment 139 requires an amount "Y" of ballast; segment 141 requires an amount "X" of ballast; and segment 143 requires an amount "A" of ballast. Each of these ballast amounts may be set forth in tons of ballast per linear mile. For each rate of travel, the operator will know the amount of discharge possible for each ballast rail car 11 in terms of ballast discharge per discharge gate 13 per unit of time. With these variables, the amount of ballast that can be deposited can be determined with some precision.

Continuing with reference to FIG. 3B, segment 137 is located between location L1 and location L2. Location L1 is determined by latitude LAT1 and longitude LON1. Location L2 is determined by latitude LAT2 and longitude LON2. Segment 139 is located between location L3 and location L4. Location L3 is determined by latitude LAT3 and longitude LON3. Location L4 is determined by latitude LAT4 and longitude LON4. Location LN is determined by latitude LATN and longitude LONN. Segment 141 is located between location L5 and location L6. Location L5 is determined by latitude LAT5 and longitude LON5. Location L6 is determined by latitude LAT6 and longitude LON6. Segment 143 is located between location L7 and location LN. Location L7 is determined by latitude LAT7 and longitude LON7. Location LN is determined by latitude LATN and longitude LONN.

A rail tunnel 131 is located between location L and location L3. In the example of FIG. 3B, there is no need to deposit a ballast in rail tunnel 131 located between location L2 and location L3. The same is true for a rail crossing 133 located between location L4 and location L5, and turnout 135 located between location L6 and location L7. Each of these locations L1, L2, L3, L4, L5, L6, L7, and LN is determined by corresponding GPS data in terms of longitude and latitude.

Figure 4:
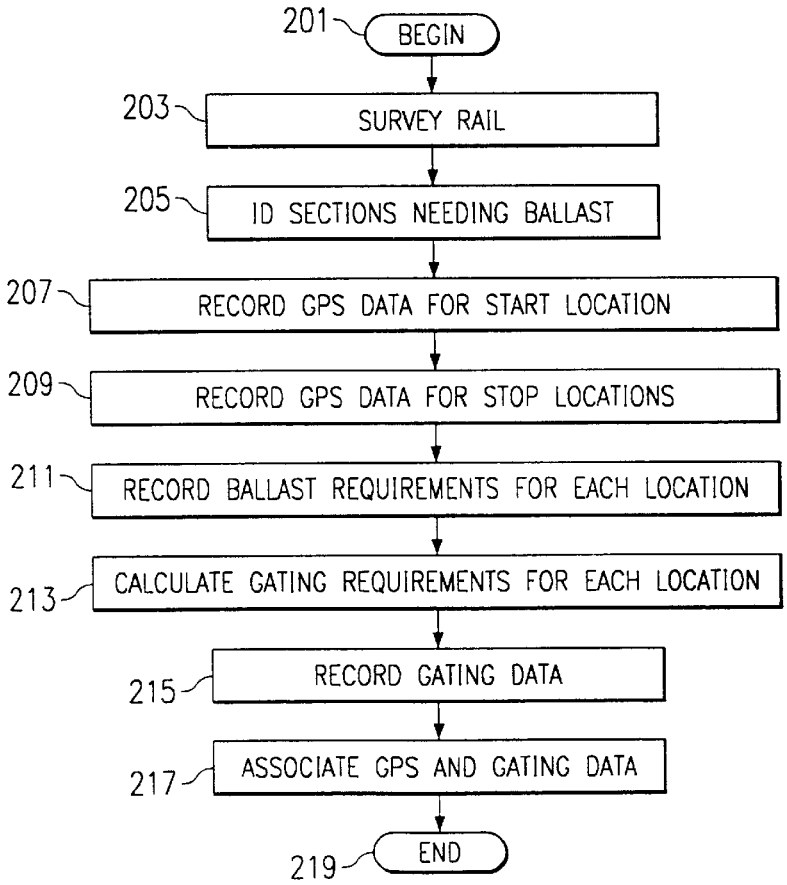
FIG. 4 if a flow-chart representation of the preferred process of determining and recording location and ballast requirements for a portion of rail line.

Referring now to FIG. 4 in the drawings, a flow chart overview of one preferred implementation of the present invention is provided. The process begins at block 201. In step 203, a survey of a section of a rail line is performed, either by railroad personnel, or with the use of GPS survey information from other railroad track maintenance applications. With reference to FIG. 3A, the survey would include rail segment 127 which is located between location L1 and location LN. Next, in accordance with step 205, the sections which need additional ballast are identified, either by railroad personnel, or with the use of GPS survey information from other railroad track maintenance applications. With reference to the example of FIG. 3B, rail tunnel 131, railroad crossing 133, and turnout 135 do not require additional ballast. Next, in accordance with step 207, the GPS system data for each start location is recorded. Likewise, in accordance with step 209, the GPS data for each stop location is recorded. With reference to the example of FIG. 3B, the start locations are location L1, location L3, location L5, and location L7. Furthermore, the stop locations are location L2, location L4, location L6, and location LN. In accordance with step 211, the ballast requirements for each segment are recorded. Again, with reference to the example of FIG. 3B, segment 137 which is between locations L1 and L2 requires a ballast in the amount of "X." Segment 139 which is located between location L3 and location L4 requires ballast in an amount of "Y." Segment 141 which is located between location L5 and location L6 requires ballast in an amount of "Z." Segment 143 which is located between location L7 and location LN requires ballast in the amount of "A."

Continuing with reference to the flow chart of FIG. 4, in accordance with steps 213 and 215, CPU 107 has been programmed to calculate and record gating requirements based upon various amounts of ballast for each location and at varying speeds of unloading. Then, in accordance with step 217, programmed CPU 107 associates the GPS location data and the gating requirements data. Essentially, a data base is built which maps out a plan for depositing ballast along predetermined sections of rail which need the ballast. The process ends at step 219.

Referring now to FIG. 5 in the drawings, a flow chart representation of the preferred implementation of the present invention is illustrated. The process begins at block 251 and continues at block 253, wherein, the CPU 107 of FIG. 2 loads the GPS data and associated ballast amounts and gate requirements data into RAM memory 109 and ROM memory 111. Then, in accordance with step 255, CPU 107 reads the GPS signals from GPS receiver 105. Then, in accordance with step 257, CPU 107 compares the GPS signal to the GPS signal maintained in the data base. In accordance with blocks 259 and 263, CPU 107 determines through this comparison whether discharge gates 13 are required to be open or closed if there is a match. If there is a match for an open gate condition, CPU 107 will then signal an appropriate control valve 113, 115, or 117 to open corresponding discharge gates 13 in accordance with step 261. However, if the comparison of the GPS signal with the GPS data in the data base results in a match for a closed gate condition, CPU 107 will then signal an appropriate control valve 113, 115, or 117 to close corresponding discharge gates 13 in accordance with step 265. For the example of FIG. 3B, this process is iteratively repeated until section 127 of rail line is traveled in its entirety. In this manner, pre-selected discharge gates 13 are opened and closed at predetermined locations in order to deposit a predetermined amount of ballast to build up the road bed to a desired level.

Referring now to FIG. 6 in the drawings, a pictorial representation of a portion of a ballast train according to the present invention is illustrated. In a typical operation, five ballast rail cars C1, C2, C3, C4, and C5 may be simultaneously discharging ballast at a predetermined rate over a pre-selected segment of rail line. The system and CPU 107 of the present invention receive and compare GPS data to determine when to open and close discharge gates 13 so as to discharge the predetermined amounts of ballast at the predetermined segments of the rail line. When cars C1, C2, C3, C4, and C5 are empty, CPU 107 cause other cars to begin discharging ballast.

Referring now to FIG. 7 in the drawings, a tabular representation of the operation depicted in FIG. 3B is illustrated. A table 100 shows the correlation between the position intervals of the ballast train relative to locations L1, L2, L3, L4, L5, L6, L7, and LN; the amount of ballast discharged during these intervals; and whether discharge gates 13 are in the open condition or the closed condition.

It should be understood that the present invention may be used on ballast discharge railcars of original manufacture, or may be used in retrofit applications on existing ballast discharge railcars. In retrofit applications, the existing control systems for opening and closing the discharge gates of the existing ballast discharge railcars are replaced by the control systems of the present invention, as necessary to utilize the GPS data.

Although the present invention has been described with reference to the preferred embodiment of discharging ballast on railroad beds, it should be understood that the present invention may be utilized in any railroad application in which it is desirable to discharge a selected amount of cargo at selected points or over selected distances.

It should be apparent from the foregoing that an invention having significant advantages has been provided. While the invention is shown in only one of its forms, it is not just limited but is susceptible to various changes and modifications without departing from the spirit thereof. Various modifications of the disclosed embodiments as well as alternative embodiments of the invention will become apparent to persons skilled in the art upon reference to the description of the invention. It is therefore contemplated that any appended claims will cover any such modifications or embodiments that fall within the scope of the invention.

We claim:

1. A method of discharging cargo from a railcar at selected locations along a rail line, the method comprising the steps of:

identifying selected locations of the rail line at which cargo is to be discharged;

providing a cargo discharge railcar having a generally rectangular base structure and a plurality of walls coupled to the base structure, thereby defining an enclosure for carrying cargo, a hopper portion coupled to the base structure, and a discharge gate coupled to the hopper portion;

coupling a control system to the discharge gate;

electrically coupling a central processing unit to the control system;

providing a receiver for receiving longitude and latitude data from a global positioning system orbiting the Earth;

electrically coupling the receiver to the central processing unit;

moving the railcar along the rail line;

receiving the longitude and latitude data;

comparing the selected locations of the rail line at which cargo is to be discharged with the longitude and latitude data comprising the steps of:

electrically coupling memory modules to the central processing unit;

building a data base of the selected locations of the rail line at which the ballast material is to be discharged comprising the steps of:

recording a start location for each selected location;

recording a stop location for each selected location; and recording ballast discharge requirements for each selected location, wherein the ballast discharge requirements include the amount of ballast material required at each selected location, the rate of discharge of the ballast material from the railcar for selected openings of the discharge gate, and the velocity of the railcar;

storing the data base in the memory modules; and comparing the longitude and latitude data with the data stored in the data base; and signaling the control system with the central processing unit to open and close the discharge gate when the railcar is at the selected locations as determined by the longitude and latitude data, thereby discharging the cargo.

2. The method of discharging cargo from a railcar according to claim 1, wherein the step of identifying selected locations of the rail line at which cargo is to be discharged is performed by a manual inspection.

3. The method of discharging cargo from a railcar according to claim 1, wherein the step of identifying selected locations of the rail line at which cargo is to be discharged is performed by using global positioning system survey information from other railroad track maintenance applications.

4. The method of discharging cargo from a railcar according to claim 1, wherein the cargo is discharged during a single continuous opening of the discharge gate.

5. The method of discharging cargo from a railcar according to claim 1, wherein the cargo is discharged over multiple cycles of opening and closing the discharge gate.

6. The method of distributing cargo from a railcar according to claim 1, wherein the cargo is rail bed ballast material.

* * * * *